US005248932A

United States Patent [19]

Prentice

[11] Patent Number: 5,248,932

[45] Date of Patent: Sep. 28, 1993

[54] CURRENT MIRROR CIRCUIT WITH CASCODED BIPOLAR TRANSISTORS

[75] Inventor: John S. Prentice, Palm Bay, Fla.

[73] Assignee: Harris Corporation, Melbourne, Fla.

[21] Appl. No.: 474,172

[22] Filed: Jan. 13, 1990

[51] Int. Cl.[5] ..... G05F 3/26

[52] U.S. Cl. ..... 323/315; 307/254; 307/299.2

[58] Field of Search ..... 323/315, 316; 330/288; 307/299.2, 254; 328/202

[56] References Cited

U.S. PATENT DOCUMENTS

| | | | |
|---|---|---|---|
| 3,835,410 | 9/1974 | Wittlinger | 323/315 |
| 3,936,725 | 2/1976 | Schneider | 323/315 |
| 4,092,552 | 5/1978 | Hoehn | 307/299.2 |
| 4,471,292 | 9/1984 | Schenck et al. | 323/315 |
| 4,518,926 | 5/1985 | Swanson | 330/288 |
| 4,591,804 | 5/1986 | van Tuijl | 323/316 |
| 4,689,607 | 8/1987 | Robinson | 323/315 |
| 4,879,524 | 11/1989 | Bell | 330/288 |

FOREIGN PATENT DOCUMENTS

| | | | |
|---|---|---|---|
| 2547176 | 4/1977 | Fed. Rep. of Germany | 307/254 |
| WO82/00550 | 2/1982 | World Int. Prop. O. | 330/288 |

*Primary Examiner*—William H. Beha, Jr.

*Attorney, Agent, or Firm*—Charles E. Wands

[57] ABSTRACT

A current mirror having an output-to-input current ratio less than unity comprises first and second transistors connected in cascode between an output terminal and a reference terminal, with the base drive of each transistor coupled to the same diode junction. Cascoding plural transistors effectively reduces the base-emitter voltage of the output transistor by the collector-emitter voltage of the other transistor, which normally operates at saturation. The other transistor may be a multi-emitter transistor, with one of the emitters coupled to its base and another of which coupled to the reference terminal. By the addition of a resistor between the emitter-collector connection of the cascoded transistors and the input terminal, the operation of the circuit may be changed from that of a current mirror to a current switch. Rather than being referenced to the rectifying junction of a diode, the base drives of the cascoded transistors may be referenced to other junction devices, such as a bipolar transistor, diode-connected bipolar transistor, Schottky diode, or a control (cathode) gate of a silicon controlled rectifier (SCR). The latter connection has particular utility in controlling the turn-off of a gate turn-off thyristor (GTO SCR), such as may be incorporated in a regulated power supply circuit.

9 Claims, 3 Drawing Sheets

CURRENT MIRROR CIRCUIT WITH CASCODED BIPOLAR TRANSISTORS

FIELD OF THE INVENTION

The present invention relates to current supply circuits and is particularly directed to a new and improved current mirror for supplying an output current, the ratio of the magnitude of which to that of the input current may be set at a value which is considerably less than unity.

BACKGROUND OF THE INVENTION

FIG. 1 schematically illustrates a simple, conventional bipolar-configured, diode-referenced current mirror circuit, commonly employed as part of a large integrated circuit architecture for supplying a controlled current, via an output terminal 10 to an associated circuit device, in accordance with a control input at input terminal 12. Specifically, an NPN transistor 14 has its collector-emitter path connected in series between output terminal 10 and a reference terminal 16, and its base-emitter forward voltage coupled across the rectifying junction of diode 18. Where it is desired that the output current, flowing into collector 14C of transistor 14, be smaller than the input current flowing into terminal 12, it is common practice to reduce the size of the junction area of transistor 14, while making the junction area of diode 18 large. Depending upon the parametric ratio sought, however, process variations to accommodate a particular set of device constraints are typically accompanied by added complexity and cost.

SUMMARY OF THE INVENTION

In accordance with the present invention, tailoring the characteristics of the current mirror, without the need to modify device parameters of one or more individual components, particularly a reduction in the output-to-input current ratio (e.g. to a value less than unity), is readily accomplished by connecting a second transistor in cascode, i.e. in the base-emitter drive path of the current mirror output transistor, and referencing the base drive of the second transistor to the same diode junction as the current mirror output transistor. This cascoding of plural transistors effectively reduces the base-emitter voltage of the output transistor by the collector-emitter voltage of the second transistor, which normally operates at saturation. As a consequence, as the base-emitter drive voltage, that of the reference diode junction is incrementally reduced, the output (collector) current of the output transistor can be reduced by multiples of an order of magnitude of that obtained without the incorporation of the additional transistor. The second, or additional, transistor may be a multi-emitter transistor, with one of the emitters coupled to its base and another of which coupled to the reference terminal.

By the addition of a resistor between the emitter-collector connection of the cascoded transistors and the input terminal, the operation of the circuit may be changed from that of a current mirror to a current switch. At low current levels, the additional transistor sinks a portion of the input current, thereby reducing the voltage drop across the reference diode and increasing the collector-emitter voltage of the second transistor. The net effect is to keep the voltage seen be the base-emitter junction of the output transistor sufficiently low that it is maintained in a turned-off state.

Once the input current increases sufficiently to overcome the partial current sinking action of the second transistor, and the second transistor becomes fully turned-on, the circuit operates in the previously described current mirror mode.

Rather than being referenced to the rectifying junction of a diode, the base drives of the cascoded transistors may be referenced to other junction devices, such as a bipolar transistor, diode-connected bipolar transistion, Schottky diode, or a control (cathode) gate of a silicon controlled rectifier (SCR). The latter connection has particular utility in controlling the turn-off of a gate turn-off thyristor (GTO SCR), such as may be incorporated in a regulated power supply circuit architecture of the type described in my copending patent application Ser. No. 474,417, entitled: "Turn-off Circuit for Gate Turn-off SCR", filed on even date herewith, assigned to the assignee of the present application and the disclosure of which is incorporated herein.

Specifically, in the GTO-SCR control circuit detailed in the above-referenced copending application, under the control of an auxiliary thyristor which controllably removes current from the cathode gate of the GTO SCR, a switching transistor is controlled (turned-on), so that its collector-emitter current flow path bridges the anode and the anode gate of the GTO SCR, and thereby effects an injection of anode gate current (at the same time that current is being removed from the cathode gate). Control of the base drive to the this transistor is preferably accomplished by means of the current mirror drive circuit of the present invention which, as pointed out above, is able to achieve a significant reduction in the output-to-input current ratio In a GTO SCR turn-off application, such a ratio may be required to be approximately an order of magnitude less than unity (for example, where input current is on the order of 2 milliamps and a collector current on the order of only 100 microamps, if desired), in order to minimize power dissipated in the current output transistor in the presence of a large (several hundred volts) voltage drop across the turned-off SCR.

In accordance with the present invention, this is readily accomplished by virtue of the second transistor in the base-emitter drive path of the current mirror output transistor, so that the base-emitter voltage of the mirror output transistor is effectively reduced by the collector-emitter voltage of the second transistor, which normally operates at saturation. Indeed, as the base-emitter drive voltage, i.e. that of the referenced cathode gate is incrementally decreased, the output (collector) current of the mirror output transistor can be reduced by multiples of an order of magnitude of that obtained without the incorporation of the additional transistor.

Thus, by referencing the improved current mirror circuit of the present invention that of the cathode gate of the auxiliary control thyristor, which is used to controllably remove current from the cathode gate of the GTO-SCR, simultaneous, precision control the mirror output current for driving base electrode of an anode gate current injection transistor, is afforded.

DETAILED DESCRIPTION

Figure 1:
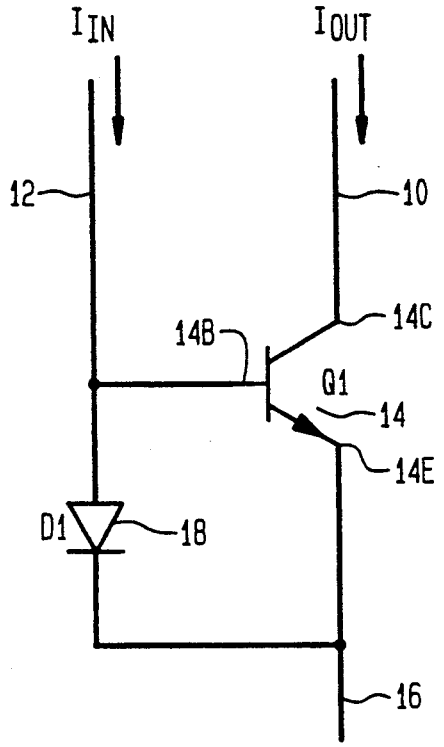
FIG. 1 schematically illustrates a conventional bipolar-configured, diode-referenced current mirror circuit.
Figure 2:
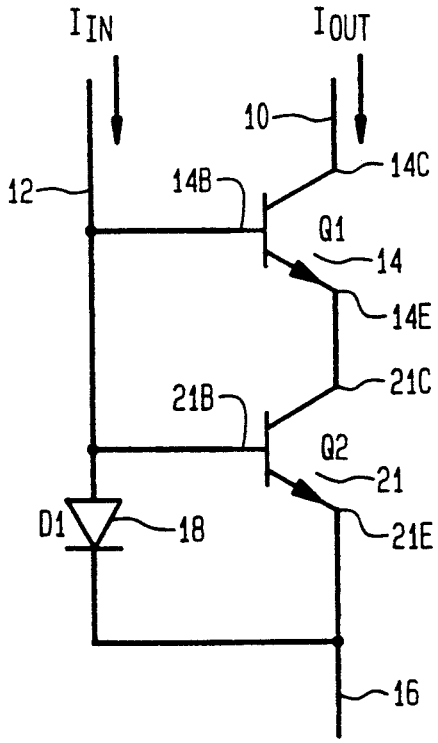
FIG. 2 is a schematic diagram of an improved modification of the current mirror circuit of FIG. 1 in accordance with a first embodiment of the present invention.

Referring to FIG. 2, a schematic diagram of an improved modification of the current mirror circuit of FIG. 1, described above, is shown as including an additional transistor 21 having its collector-emitter current path connected in series with the collector-emitter current path of transistor 14 between current output terminal 10 and reference terminal 16. Namely, like the configuration of FIG. 1, the improved current mirror circuit of FIG. 2 has a current input terminal 12 which is coupled to the base 14B of NPN transistor 14 and to the anode of diode 18, the cathode of which is coupled to reference terminal 16 (e.g. ground or an AC return). In addition, the anode terminal of diode 18 is coupled to the base 21B of additional NPN transistor 21, the collector-emitter current path of which is coupled in series with the collector-emitter path of transistor 14 between output terminal 10 and reference terminal 16.

The addition of cascoded transistor 21 effectively reduces the base-emitter voltage of current mirror output transistor 14 by the collector-emitter voltage of transistor 21. Because transistor 21 normally operates at saturation, its base current is normally considerably larger than that of output transistor 14 and both base currents constitute error terms for the output current Iout supplied from terminal 10. Moreover, the base current of transistor 21 may even be larger than the output current. However, since the input current Iin is much larger than output current Iout, the error in the ratio of input current to output current is acceptable.

The collector-emitter voltage of output transistor 14 may be defined as:

$$Vce = Vt*(\ln(1+K1) - \ln(1-K2)),$$

where

Vt=kT/q (thermal voltage)

K1=1/Br (Br=inverse operation current gain)

K2=Ic/Ic max (Ic=collector current, Ic max=maximum collector current that could flow for the same Vbe).

Assuming that the values for emitter and collector resistances are not significant, then for values of K2<<1, $$Vce = Vt*\ln(1+K1) + Ic*Rsat,$$

where

Rsat=Vt/(Ic max).

Figure 3:
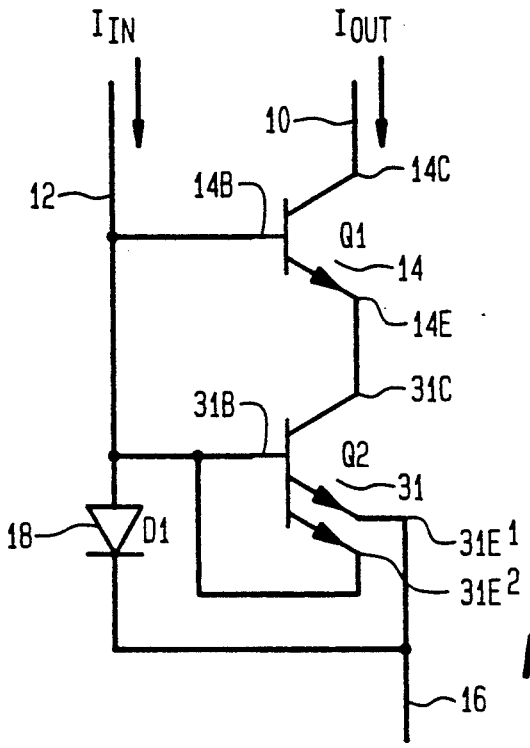
FIG. 3 is a modification of the embodiment of the current mirror of FIG. 2, in which the saturation transistor is a multi-emitter transistor.

To increase K1, the second transistor may be configured as a multi-emitter transistor 31, as shown in FIG. 3, wherein emitter 31E1 is connected to reference terminal 16 and additional emitter 31E2 is connected to its base 31B. By adjusting the ratio the areas of its emitters, the value of K1 can be changed. It should be noted that the configurations of each of FIGS. 2 and 3 yields an output current to input current ratio of less than one.

Figure 4:
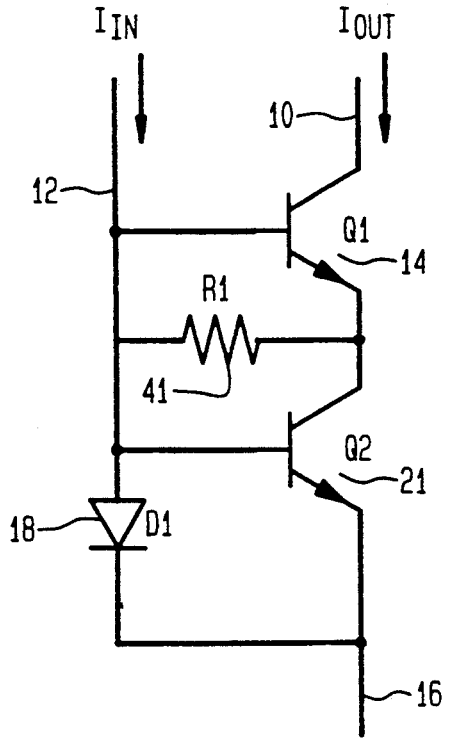
FIG. 4 shows the addition of a resistor between the emitter-collector connection of the cascoded transistors and the input terminal, which changes the operation of the circuit from that of a current mirror to a current switch.

As noted briefly above, adding a resistor between the emitter-collector connection of the cascoded transistors and the input terminal changes the operation of the circuit from that of a current mirror to a current switch. Such a configuration is shown in FIG. 4, where a resistor 41 is connected between the emitter-collector connection node 43 of cascoded transistors 14 and 21 and input terminal 12 of the configuration of FIG. 2. At low current levels, transistor 21 sinks a portion of the input current, thereby reducing the voltage drop across diode 18 and increasing the collector-emitter voltage of transistor 21. The net effect is to keep the voltage seen be the base-emitter junction of output transistor 14 sufficiently low to keep it turned-off. Once the input current Iin increases to a threshold value which overcomes the partial current sinking action of transistor 21, and transistor 21 becomes fully turned-on, the circuit operates in the previously described current mirror mode. This threshold value Ith may be defined approximately as:

$$Ith = Vdiode/R.$$

Rather than being referenced to the rectifying junction of a diode, the base drives of the cascoded transistors may be referenced to other junction devices, such as a bipolar transistor, diode-connected bipolar transistor, Schottky diode, etc., as noted above. In addition, as pointed out briefly above and as described in detail in my above-referenced copending application, wherein the current mirror of the present invention is employed as part of a turn-off control circuit for a GTO SCR, the base drive inputs of the current mirror transistors may be referenced to the cathode gate of a silicon controlled rectifier (SCR).

Figure 5:
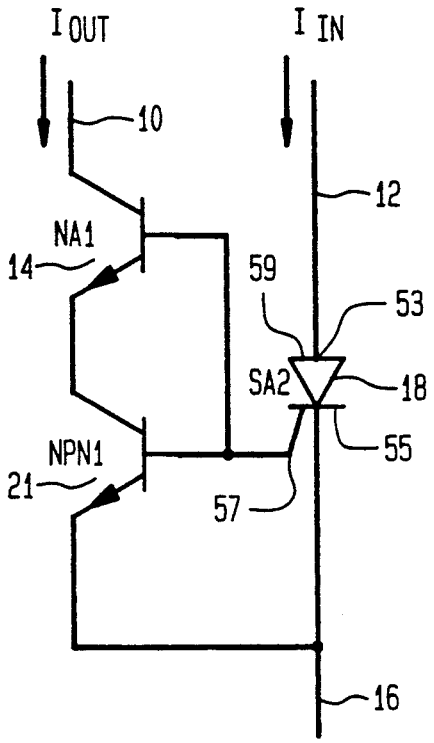
FIG. 5 shows an embodiment of a current mirror according to the present invention employed as part of a turn-off control circuit for a GTO SCR, wherein the base drive inputs of the current mirror transistors are referenced to the cathode gate of a silicon controlled rectifier.

More particularly, as diagrammatically illustrated in FIG. 5, the input current reference diode is shown as being replaced by a thyristor 51, which has an anode 53 coupled to input terminal 12 and a cathode terminal 55 coupled to reference terminal 16. Thyristor 51 further has a cathode gate 57 coupled to the base electrodes 14B and 21B of transistors 14 and 21, respectively. In the improved GTO SCR turn-off control circuit described in my copending application, thyristor 51 has its anode 53 coupled to the cathode gate of the GTO SCR and its anode gate 59 coupled to receive a turn-off control signal (such as that supplied by a line voltage comparator).

In operation, with control thyristor 51 and the current mirror in an off state (the GTO SCR to be turned off is presently conductive), a negative-going control voltage is applied to anode gate 59, thereby turning the thyristor on. When thyristor 51 conducts, the cathode gate of the GTO SCR, to which anode 53 of thyristor 51 is coupled, becomes reverse-biased relative to its cathode, so that current is removed from the cathode gate of the GTO SCR, which is sufficient to turn the GTO SCR off.

In accordance with the improved GTO SCR turn-off control circuit described in my copending application, the potentially damaging effects of tail current which accompanies turn-off are substantially circumvented obviated by turning on a transistor, the collector-emitter path of which bridges the anode and anode gate of the GTO SCR, thereby injecting current into the anode gate of the GTO SCR, simultaneously with the cathode gate current removal action of thyristor 51.

For this purpose, when thyristor 51 is turned on by the negative-going voltage on its anode gate 59, the change in voltage at its cathode gate 57 biases current mirror transistors 14 and 21 on, so that output terminal 10 and the base of the bridging transistor see a mirror output current which drives the bridging transistor into saturation. With its PNP emitter-collector path optimally conductive, electrons stored in the anode gate region of the GTO SCR are rapidly depleted via the anode gate contact. As a consequence, its anode is prevented from injecting holes back into the anode gate region, thereby effectively eliminating the source of the potentially damaging tail current. With the bridging transistor driven into saturation, the base-emitter junction of the PNP transistor portion of the GTO SCR thyristor is effectively shorted out, reducing its current gain to much less than one. Since the current mirror drive circuit of the present invention is able to achieve a significant reduction in its output-to-input current ratio, its collector current may be kept at a very low value (e.g. on the order of only 100 microamps for an input current of 2 milliamps), thereby minimizing power dissipated in the current output transistor in the presence of a large (several hundred volts) voltage drop across the turned-off SCR.

Figure 6:
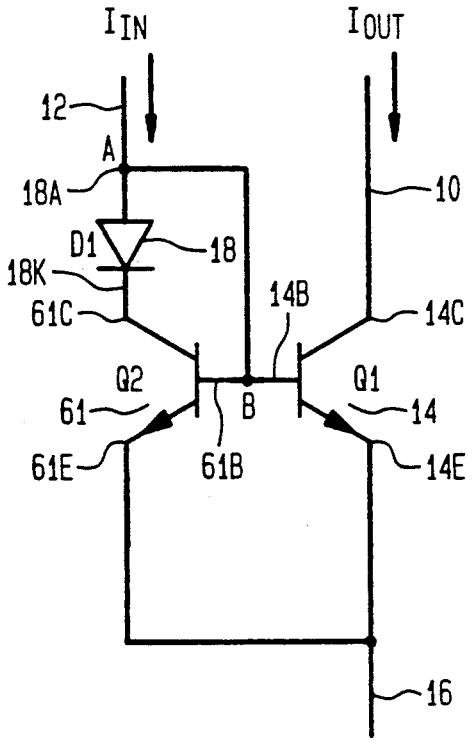
FIG. 6 shows a further embodiment of a current mirror according to the present invention having an additional transistor inserted at a location which increases the base-emitter voltage of the output transistor so that the current ratio is greater than one.

In each of the above embodiments, a second transistor is connected in cascode with the current mirror output transistor, i.e. in its the base-emitter drive path, with its base drive referenced to the same diode junction as the current mirror output transistor. This cascoding of the two transistors reduces the base-emitter voltage of the output transistor by the collector-emitter voltage of the second transistor (operating at saturation), so that an output-to-input current ration of less than one can be obtained. In accordance with a further embodiment of the present invention, the additional transistor is inserted at a location to increase the base-emitter voltage of the output transistor, so that the current ratio is greater than one. Such a configuration is schematically illustrated in FIG. 6, which shows the collector-emitter path of a second transistor 61 coupled between cathode 18K of diode 18 and reference terminal 16, rather than between the emitter of current output transistor 14 and the reference terminal 16, as in the previously described embodiments. Each of transistors 41 and 61 has its base referenced to the anode 18A of diode 18, as in embodiments of FIGS. 2–5. Thus the base-emitter voltage of output transistor 14 is the sum of the voltage drop across diode 18 and the collector-emitter drop of transistor 61. In this embodiment should the base currents of transistors 14 and 61 become significant error terms, the direct connection between bases 61B and 14B and the anode 18A may be replaced by a buffer circuit (such as a JFET operating at zero Vgs).

As will be appreciated from the foregoing description, the current mirror circuit of the present invention enables the output-to-input current ratio to be reduced to a value less than unity by connecting a second transistor in cascode, i.e. in the base-emitter drive path of the current mirror output transistor, and referencing the base drive of the second transistor to the same diode junction as the current mirror output transistor. This cascoding of plural transistors effectively reduces the base-emitter voltage of the output transistor by the collector-emitter voltage of the second transistor, which operates at saturation. As the base-emitter drive voltage is incrementally reduced, the collector current of the output transistor can be reduced by multiples of an order of magnitude of that obtained without the incorporation of the additional transistor.

Such a current mirror circuit has particular utility as providing current drive to a switching transistor for controlling the turn-off of a gate turn-off thyristor (GTO SCR) in a regulated power supply circuit and minimizing power dissipation in the output current transistor in the presence of a large (on the order of several hundred volts) off voltage across the GTO SCR.

While I have shown and described several embodiments in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed is:

1. A current mirror circuit comprising:

a current input terminal;

a current output terminal;

a reference terminal;

a silicon controlled rectifier having an anode, a cathode, and a cathode gate, said anode being coupled to said current input terminal and said cathode being coupled to said reference terminal; and first and second transistors having their collector-emitter current flow paths coupled in series between said current output terminal and said reference terminal, and having their base electrodes coupled to the cathode gate of said silicon controlled rectifier.

2. A current mirror circuit according to claim 1, wherein one of said plurality of transistors has a plurality of emitters one of which is coupled to its base and another of which is coupled to said reference terminal.

3. A current mirror circuit comprising:

a current input terminal;

a current output terminal;

a reference terminal;

a rectifier device having a first electrode coupled to said current input terminal;

a first transistor having an input electrode coupled to a second electrode of said rectifier device, an output electrode coupled to said reference terminal and a control electrode coupled to said current input terminal; and a second transistor having an input electrode coupled to said current output terminal, an output electrode coupled to said reference terminal and a control electrode coupled to said current input terminal.

4. A current mirror circuit according to claim 3, wherein said rectifier device comprises a diode.

5. A current mirror circuit according to claim 3, wherein each of said first and second transistors comprises the same polarity type bipolar transistor, the base of which corresponds to said control electrode, the collector electrode of which corresponds to said input electrode and the emitter electrode of which corresponds to said output electrode.

6. A current mirror circuit comprising:

a current input terminal;

a current output terminal;

a reference terminal;

a rectifier device having a first electrode coupled to said current input terminal;

a plurality of bipolar transistor having their current flow paths coupled in series between said current output terminal and said reference terminal, and having respective control electrodes connected in common and coupled to said rectifier device; and wherein said rectifier device comprises a thyristor, the anode and cathode of which are coupled in circuit with said input current terminal and said reference terminal, and a gate electrode of which is coupled to the control electrodes of said plurality of bipolar transistors.

7. A current mirror circuit comprising:

a current input terminal;

a current output terminal;

a reference terminal;

a rectifier device coupled between said current input terminal and said reference terminal;

a plurality of bipolar transistor having their current flow paths coupled in series between said current output terminal and said reference terminal, and having respective control electrodes connected in common and coupled to said rectifier device; and wherein said rectifier device comprises a thyristor, the anode and cathode of which are coupled in circuit with said input current terminal and said reference terminal, and that one of its gate electrodes which is associated with the one of the anode and cathode, that is coupled to said reference terminal, is coupled to the control electrodes of said plurality of bipolar transistors.

8. A current mirror circuit comprising:

a current input terminal;

a current output terminal;

a reference terminal;

a rectifier device coupled between said current input terminal and said reference terminal;

a first bipolar transistor having a collector coupled to said current output terminal, a base electrode coupled to one electrode of said rectifier device and an emitter electrode; and a second bipolar transistor having a collector coupled to the emitter electrode of said first bipolar transistor, a base electrode connected in common with the base electrode of said first bipolar transistor and coupled to said one electrode of said rectifier device and an emitter electrode coupled to said reference terminal; and wherein said rectifier device comprises a thyristor, the anode and cathode of which are coupled in circuit with said input current terminal and said reference terminal, and a gate electrode of which is coupled to the base electrodes of said first and second bipolar transistors.

9. A current mirror circuit comprising:

a current input terminal;

a current output terminal;

a reference terminal;

a rectifier device coupled between said current input terminal and said reference terminal;

a first bipolar transistor having a collector coupled to said current output terminal, a base electrode coupled to one electrode of said rectifier device and an emitter electrode; and a second bipolar transistor having a collector coupled to the emitter electrode of said first bipolar transistor, a base electrode connected in common with the base electrode of said first bipolar transistor and coupled to said one electrode of said rectifier device and an emitter electrode coupled to said reference terminal; and wherein said rectifier device comprises a thyristor, the anode and cathode of which are coupled in circuit with said input current terminal and said reference terminal, and that one of its gate electrodes which is associated with the one of the anode and cathode, that is coupled to said reference terminal, is coupled to the base electrodes of said first and second bipolar transistors.

* * * * *